United States Patent [19]

MacDonald

[11] 3,997,205

[45] Dec. 14, 1976

[54] CABINET DOOR CLIP

[76] Inventor: Kenneth A. MacDonald, 251 York St., Canton, Mass. 02021

[22] Filed: July 7, 1975

[21] Appl. No.: 593,265

[52] U.S. Cl. ..... 292/288; 292/145

[51] Int. Cl.[2] ..... E05C 1/04

[58] Field of Search ..... 292/145, 147, 149, 152, 292/253, 288, 292

[56] References Cited

UNITED STATES PATENTS

| | | | |
|---|---|---|---|
| 2,485,189 | 10/1949 | Churchill | 292/288 X |
| 2,918,318 | 12/1959 | Sacharski | 292/288 X |
| 3,069,217 | 12/1962 | Kors | 292/145 |
| 3,623,268 | 11/1971 | Zepf | 292/145 X |
| 3,785,685 | 1/1974 | MacDonald | 292/288 |

FOREIGN PATENTS OR APPLICATIONS

| | | | |
|---|---|---|---|
| 448,495 | 5/1948 | Canada | 292/288 |

*Primary Examiner*—Richard E. Moore

*Attorney, Agent, or Firm*—Morse, Altman, Oates & Bello

[57] ABSTRACT

A one-piece clip is provided for temporarily locking a cabinet door in a closed position. The clip is fabricated from a stiff, resilient material such as metal or plastic, wire or ribbon and is formed with a pair of reversing relatively deep U-shaped bends. The free end of one bend is shorter than the free end of the other bend and is also shorter than the cross-piece of the other bend whereby the clip, when mounted over the door jamb of the cabinet, is capable of limited lateral movement to allow the door first to swing clear for opening and installation and to be locked by laterally shifting the clip so that the outer U-shaped end engages the edge of the door in the closed position. The clip may be used for keeping the door shut during shipment of newly assembled cabinets, for example.

6 Claims, 7 Drawing Figures

CABINET DOOR CLIP

BACKGROUND OF THE INVENTION

1. Field Of The Invention

This invention relates generally to door clips and more particularly is directed towards a new and improved, inexpensive, one-piece door clip of a disposable nature adapted to quickly and easily lock a cabinet door in a closed position.

2. Description Of The Prior Art

In the manufacture of kitchen cabinets and similar products equipped with doors hinged to a frame, problems arise with respect to the doors being damaged during handling or shipping. Typically, cabinets of this type use a relatively low release magnetic or mechanical latch which may yield when the cabinet is tipped or jarred. Frequently the doors are damaged when swinging under their own force on the hinges or by striking another object. Various measures have been employed to restrain the doors temporarily and protect them against accidental opening. These measures have included the application of pressure sensitive tape, staples or barbed pieces of metal bent around the cabinet frame and around the door. None of the measures thus far available have been found to be entirely satisfactory. For example, the tape tends to damage the finish of the cabinet or may leave a residue of adhesive. Similarly, the use of staples produces permanent holes in the cabinet and are undesirable. Various types of mechanical securing devices have been developed but these usually are difficult to install and remove, are overly expensive for the task involved or tend to mar the cabinet in one way or another.

Accordingly, it is an object of the present invention to provide a very effective, simple, and low cost door clip which is quickly and easily installed on a cabinet and door assembly for restraining the door in a locked position. Another object of this invention is to provide a cabinet door clip which may be installed and removed with no damage to the cabinet and which may be left on the cabinet to serve as a simple door lock.

SUMMARY OF THE INVENTION

This invention features a cabinet door clip, comprising a one-piece device in ribbon or wire form and of a stiff resilient material formed with a pair of reversing U-shaped bends, the first bend adapted to engage the fixed frame or jamb of the cabinet or the like while the second bend is adapted to engage the free edge of the door. The first bend is deeper than the second bend to allow lateral shifting of the clip on the door frame by means of which the door can be moved to an open or closed position with the clip in one extreme position or be locked by shifting the clip to an opposite position.

DETAILED DESCRIPTION OF THE PREFERRED EMBODIMENTS

Figure 1:
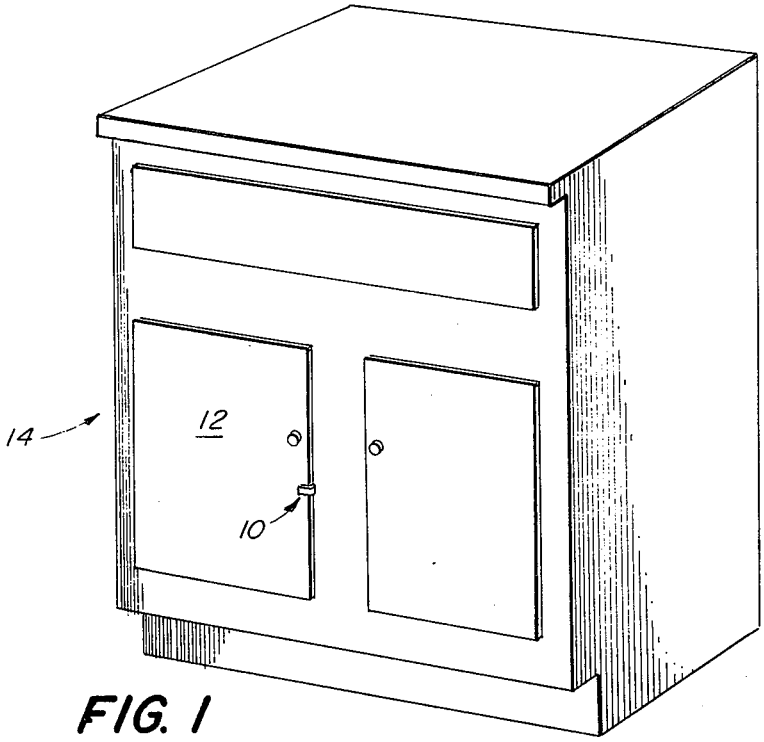
FIG. 1 is a view in perspective of a typical cabinet having a door locked by means of a clip made according to the invention.

Referring now to the drawings the reference character 10 generally indicates a door clip adapted to secure in a locked and closed position a door 12 of a cabinet 14, particularly during shipment thereof. The cabinet 14 may be the base of a kitchen unit such as shown in FIG. 1 or could be of any other cabinetwork utilizing hinged doors. The door clip 10, in the preferred embodiment, is a one-piece device which may be fabricated of a relatively stiff resilient material such as metal or various types of stiff plastic such as PVC, nylon or the like. The clip may be fabricated by various techniques such as molding or bending or if the device is aluminum it may be manufactured by extrusion techniques. In any event the clip 10 is formed with a pair of oppositely facing U-bends 16 and 18 defined by a short leg 20, a cross-piece 22, a common center leg 24, a cross-piece 26 and an elongated bent leg 28. In the preferred embodiment all of the legs are flat and typically are on the order of ½ inch to 1 inch in width.

Figure 2:
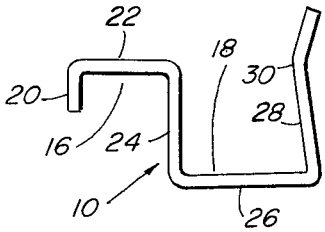
FIG. 2 is a top plan view of the door clip.

As best shown in FIG. 2 the short leg 20 is perpendicular to the cross-piece 26. The leg 28 extends in a direction opposite to the leg 20 and is inclined inwardly at a slight angle to a bend 30, preferably located opposite the leg 22, and, thereupon extends outwardly at a slight angle. The function of the bend in the leg 28 is to provide a gripping action on a door jamb 32 so that the clip will stay in position.

Figure 4:
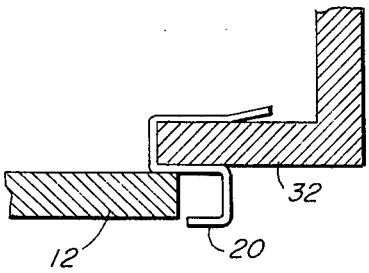
FIG. 4 is a detailed sectional view showing the clip as it is mounted on the cabinet of the door in an open position.
Figure 5:
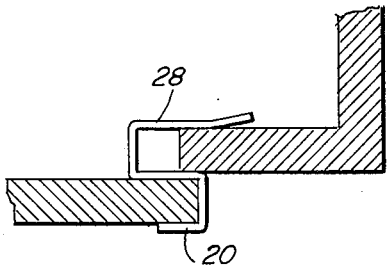
FIG. 5 is a view similar to FIG. 4 showing the clip in the door-locking position.

If the clip is to be used on a conventional kitchen cabinet of the type shown in FIG. 1, it has been found that the following dimensions provide a very satisfactory fit on the cabinet and on the door. The width of the bend 16 at the inside should be 9/16 of an inch to correspond with the typical thickness of a cabinet door 12. The length of the leg 20 preferably is on the order of ⅜ of an inch. This leg is relatively short for reasons that will presently appear. Typically, there should be ½ inch clearance between the free end of the leg 20 and the base line of the bend 18. The length of the common medial leg 24 should be on the order of ⅞ of an inch and the inside width of the bend 18 at the base should also be on the order of ⅞ of an inch to correspond with the typical thickness of the door jamb 32 formed in the front wall of the cabinet 14 as best shown in FIGS. 4 and 5. The width of the bend 18 reduces to approximately ⅝ of an inch at the bend 30 of leg 28 and the top of the common leg 24. The free end of the leg 28 then flares out to a width of ⅞ on an inch measured from the centerline of the common leg 24 and the free end of the leg 28.

The clip is installed by first pressing the bent portion 18 over the door jamb as shown in FIG. 4 so that it is pushed fully in place with the edge of the jamb butt against the cross-piece 26. As the clip is pressed into place the bent leg 28 is spread out under the wedging action of the bent free end to form substantially parallel legs which grip the door jamb. When the clip is fully in place, it will be seen that the free edge of the door 12 has sufficient clearance with the free end of the leg 20 that it may clear it and close in against the door jamb. It will be understood that the door will be in an open position while the clip is being pressed onto the door frame or jamb. The door is then shut with the clip at the extreme right hand position of FIG. 4. Once the door is shut the clip is then shifted to the left as suggested in FIG. 5 so that the leg 20 engages the front marginal edge of the door 12. Since the clip leg 28 is substantially longer than the leg 20, the leg 28 remains in engagement with the door jamb even in an extreme left hand position so that the clip effectively locks the door to the jamb. The clip is left in this position as long as the door is to be locked. The clip is easily removed by merely shifting the clip back to the position of FIG. 4 so that the door can swing free. The clip can then be removed from the door jamb and discarded or it may be left on the door jamb to serve as a simple locking device which will inhibit children from opening the cabinet.

If the clip is fabricated from a metal then it is desirable to coat the clip with plastic or the like to protect against scratching the finish of the cabinet.

Figure 6:
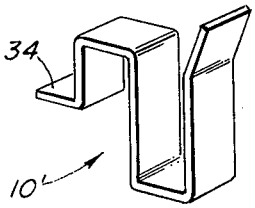
FIG. 6 is a perspective view showing a modification of the invention, and, FIG. 7 is a perspective view showing another modification of the invention.

Referring now to FIG. 6 of the drawings, there is shown a modification of the invention and, in this embodiment, a clip 10' is provided of a structure similar to that of the principal embodiment with the exception that a tab 34 has been formed integral with the leg 20 and extends perpendicularly therefrom outwardly from the bend 16. The function of the tab 34 is to facilitate gripping the clip when it is installed to shift it from the locked to the unlocked position and vice versa.

Figure 7:
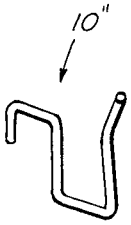
Figure 3:
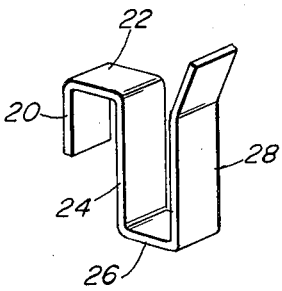
FIG. 3 is a perspective view thereof.

Referring now to FIG. 7 of the drawings, there is shown a further modification of the invention and, in this embodiment, a clip 10'' is fabricated in the same bent configuration of the principal embodiment with the exception that instead of the legs being flat the clip is formed from round stock such as wire or the like. Again, the material may be metal, plastic and if of metal should be coated to prevent scratching. The clip of FIG. 7 may be further modified by adding a tab to the short leg to provide the same function as the tab of FIG. 6.

Having thus described the invention what I claim and desire to obtain by Letters Patent of the United States is:

1. A clip for locking a hinged door to a fixed frame wherein the door is larger than the opening in said frame and bears against the outer face of said frame when in a closed position, comprising a. a unitary structure of a stiff resilient material formed with a pair of adjacent, coplanar oppositely facing and substantially rectangular U-shaped bends, b. one of said bends including a relatively short, straight outer leg adapted to engage the outer marginal face of said door, c. a first straight cross-piece extending at one end perpendicularly from said outer leg and adapted to engage the edge of said door, d. a straight medial common leg of a length substantially in excess of said outer leg extending at one end from the opposite end of said cross-piece parallel to said outer leg, e. a second straight cross-piece at a substantial distance from the free end of said short outer leg and extending at one end perpendicularly from the opposite end of said common leg in coplanar parallel relation to said first cross-piece, f. a relatively straight long inner leg coplanar to said outer leg and extending in a direction opposite thereto from the other end of said second cross-piece, the length of said inner leg exceeding that of said common leg, said inner leg adapted to engage the inner face of said frame.

2. A clip according to claim 1 wherein the dimensions of the other of said bends at the entrance thereof is less than the thickness of said frame for gripping engagement therewith.

3. A clip according to claim 1 wherein said outer leg is formed with an inwardly extending bent portion proximate to the entrance of the other U-shaped bend to reduce the width of said U-shaped bend.

4. A clip according to claim 1 wherein said legs are of flat stock of substantially constant thickness.

5. A clip according to claim 1 wherein said legs are of cylindrical stock of substantially constant thickness.

6. A clip according to claim 1 wherein said outer leg is formed with an integral outwardly extending tab.

* * * * *